US008695617B2

(12) United States Patent
Diamond

(10) Patent No.: US 8,695,617 B2
(45) Date of Patent: Apr. 15, 2014

(54) HANDLE ASSEMBLY FOR CANE

(75) Inventor: Harvey Diamond, Armonk, NY (US)

(73) Assignee: Drive Medical Design & Mfg., Port Washington, NY (US)

( * ) Notice: Subject to any disclaimer, the term of this patent is extended or adjusted under 35 U.S.C. 154(b) by 211 days.

(21) Appl. No.: 13/104,514

(22) Filed: May 10, 2011

(65) Prior Publication Data

US 2011/0271990 A1 Nov. 10, 2011

Related U.S. Application Data

(60) Provisional application No. 61/333,109, filed on May 10, 2010.

(51) Int. Cl.
*A45B 9/02* (2006.01)
*B25G 1/10* (2006.01)

(52) U.S. Cl.
CPC . *A45B 9/02* (2013.01); *B25G 1/102* (2013.01); *Y10S 135/91* (2013.01)
USPC ..... 135/72; 135/66; 135/910; 16/431; 280/821

(58) Field of Classification Search
CPC ..... A45B 9/02; A45B 9/04; B25G 1/10; B25G 1/102
USPC ..... 135/65–66, 72, 74, 910–911; 280/817, 280/819; 16/430–431, 436; 119/115; 362/102
See application file for complete search history.

(56) References Cited

U.S. PATENT DOCUMENTS

| | | | | | |
|---|---|---|---|---|---|
| 2,561,228 | A | * | 7/1951 | Richey | 135/65 |
| D187,842 | S | | 5/1960 | Jeys | |
| 3,363,639 | A | | 1/1968 | Kurpis | |
| 3,685,850 | A | * | 8/1972 | Kepka et al. | 280/821 |
| 3,768,495 | A | | 10/1973 | Smith | |
| D231,043 | S | | 3/1974 | Barnett | |
| RE28,067 | E | | 7/1974 | Hyman | |
| 3,995,650 | A | | 12/1976 | DiVito | |
| 4,234,202 | A | * | 11/1980 | Loffelholz | 280/820 |
| 4,625,742 | A | | 12/1986 | Phillips | |
| 4,730,632 | A | | 3/1988 | Mace | |
| 5,331,990 | A | | 7/1994 | Hall et al. | |
| 5,351,704 | A | | 10/1994 | Hunnicutt, Jr. et al. | |
| 5,385,163 | A | | 1/1995 | Fairchild | |
| 5,482,070 | A | | 1/1996 | Kelly | |
| 5,554,975 | A | | 9/1996 | Hall et al. | |
| 5,722,445 | A | * | 3/1998 | Hae et al. | 135/65 |
| 5,992,434 | A | | 11/1999 | Berlin et al. | |
| 6,024,110 | A | | 2/2000 | Renfro | |

(Continued)

FOREIGN PATENT DOCUMENTS

JP 2000139531 A * 5/2000 ..... A45B 9/00

*Primary Examiner* — Winnie Yip
(74) *Attorney, Agent, or Firm* — Carter, DeLuca, Farrell & Schmidt, LLP

(57) ABSTRACT

The present disclosure relates to a cane with a novel handle assembly. The handle assembly includes, among other components, an inner frame, an outer cover, and a resilient filler that is positioned between the inner frame and the outer cover to provide the handle assembly with a measure of resiliency to increase the user's comfort during use. In one embodiment of the disclosure, it is envisioned that the handle assembly may include a fluorescent material to facilitate location of the cane in poorly lit, or dim, areas.

16 Claims, 3 Drawing Sheets

(56) References Cited

U.S. PATENT DOCUMENTS

| | | | | |
|---|---|---|---|---|
| 6,131,593 | A | 10/2000 | Greene et al. | |
| 6,346,780 | B1 | 2/2002 | Parra | |
| 6,463,947 | B1 | 10/2002 | Wipperfurth | |
| 6,968,599 | B2 * | 11/2005 | Blauer et al. | 16/431 |
| D514,307 | S | 2/2006 | Gillebaard | |
| 7,004,655 | B2 * | 2/2006 | Ferrara | 401/6 |
| 7,287,538 | B2 * | 10/2007 | Lin et al. | 135/16 |
| D555,350 | S | 11/2007 | Graves et al. | |
| 7,294,110 | B2 | 11/2007 | Bourne et al. | |
| 7,409,747 | B2 * | 8/2008 | Chen | 16/430 |
| 7,441,310 | B2 * | 10/2008 | Chen | 16/430 |
| 7,475,620 | B2 * | 1/2009 | Chen | 81/489 |
| 7,540,296 | B2 | 6/2009 | Meyers et al. | |
| 7,841,353 | B2 * | 11/2010 | Lee | 135/74 |
| 2003/0145881 | A1 | 8/2003 | Harroun | |
| 2004/0036194 | A1 | 2/2004 | Chadwick et al. | |
| 2004/0226593 | A1 | 11/2004 | Robitaille et al. | |
| 2006/0169308 | A1 * | 8/2006 | Yen et al. | 135/25.4 |
| 2008/0087310 | A1 * | 4/2008 | Dahinden | 135/16 |
| 2008/0096458 | A1 * | 4/2008 | Andersen | 446/26 |
| 2009/0159107 | A1 * | 6/2009 | Davenport | 135/82 |

* cited by examiner

HANDLE ASSEMBLY FOR CANE

CROSS-REFERENCE TO RELATED APPLICATIONS

This application claims the benefit of, and priority to, U.S. Provisional Patent Application Ser. No. 61/333,109, filed on May 10, 2010, the entire contents of which are incorporated by reference herein.

BACKGROUND

1. Technical Field

The present disclosure relates to walking canes, and more particularly, to a cane with an improved handle design including features that address issues pertaining to comfort during use, visibility, and convenience.

2. Background of Related Art

Canes are well known in the art, and are generally used by the elderly, the disabled, or by other individuals that require support while walking and/or standing. As is conventional, a cane typically includes a shaft, and a handle, or hand grip.

Known handles are generally formed from either a rigid material, which allows the user to easily and securely grasp the handle, or more deformable materials, which allows for a more comfortable grip by increasing impact absorption when transferring a load. One example of a cane including a cushioned grip is described in U.S. Pat. No. 7,540,296.

Often times, canes are stored at bedside. However, should an individual wake during the night, and require the assistance offered by the cane, known canes can be difficult to locate in the dark. While canes that include a light source are known, the light source is generally activated by the user while in possession of the cane. Accordingly, such canes would do little to ease concerns regarding location of the cane in the dark, or in poorly lit areas.

Accordingly, a cane including an improved handle design addressing issues pertaining to both comfort during use, and location identification in poorly lit environments, would present significant advantages over those canes known in the art.

SUMMARY

In one aspect of the present disclosure, a handle assembly is disclosed for use with a cane. The handle assembly includes an inner frame with an upper portion, a lower portion, and opposing end portions, as well as an outer cover that is positioned about the inner frame, and a filler that is positioned between the inner frame and the outer cover.

The handle assembly is at least partially formed from a fluorescent material to facilitate visualization and location of the cane. It is envisioned that the outer cover may be at least partially comprised of a fluorescent material. Additionally, or alternatively, it is envisioned that the filler may be at least partially comprised of a fluorescent material. In such embodiments, it is further envisioned that the outer cover may be at least partially formed from a material permitting light to pass therethrough, whereby light can pass through the outer cover to charge the filler in order to facilitate the emission of light from the handle assembly.

It is envisioned that the outer cover may be at least partially formed from a resilient material, and that the filler may be comprised of a material that increases the resiliency of the handle assembly to maximize comfort during use, e.g., a gel.

In one embodiment of the handle assembly, at least one of the upper and lower portions of the inner frame includes a configuration defining a well that is configured and dimensioned to accommodate the filler. For example, the upper portion of the frame may define a well to thereby cushion a user's palm during use of the cane, and the lower portion of the frame may define a well to thereby cushion one or more of the user's fingers during use of the cane. Alternatively, the lower portion of the inner frame may include a pair of wells.

The outer cover is secured to the inner frame at the end portions and the lower portion. In one embodiment, the handle assembly further includes a pair of end members that are configured and dimensioned for engagement with the end portions of the inner frame. The end members are further configured and dimensioned for positioning about at least a portion of the outer cover to secure the outer cover to the inner frame, and thereby inhibit escape of the filler.

The handle assembly may also include a sleeve that is configured and dimensioned for engagement with the lower portion of the inner frame. The sleeve is further configured and dimensioned for positioning about at least a portion of the outer cover to secure the outer cover to the inner frame, and thereby inhibit escape of the filler.

In another aspect of the present disclosure, a cane is disclosed. The cane includes a handle assembly, and a shaft that extends from the handle assembly. The cane is at least partially formed from a fluorescent material to facilitate visualization and location of the cane.

In one embodiment, the cane includes an inner frame with an upper portion, a lower portion, and opposing end portions, as well as an outer cover that is positioned about the inner frame, and a filler that is positioned between the inner frame and the outer cover.

It is envisioned that the outer cover and/or the filler may be comprised of a material that increases the resiliency of the handle assembly to maximize comfort during use of the cane.

It is envisioned that the handle assembly may be at least partially formed from a fluorescent material. For example, the outer cover and/or the filler may at least partially comprise a fluorescent material. In those embodiments employing a fluorescent filler, the outer cover may be at least partially formed from a material permitting light to pass therethrough, whereby light passes through the outer cover to charge the filler in order to facilitate the emission of light from the cane.

In a final aspect of the present disclosure, an improved cane is disclosed. The improvement to the cane comprises at least partially forming the cane from a fluorescent material to facilitate visualization and location thereof.

BRIEF DESCRIPTION OF THE DRAWINGS

Various embodiments of the presently disclosed cane, and handle assembly for use therewith, will be described herein below with reference to the accompanying drawings, wherein.

DESCRIPTION OF VARIOUS EMBODIMENTS

Figure 1:
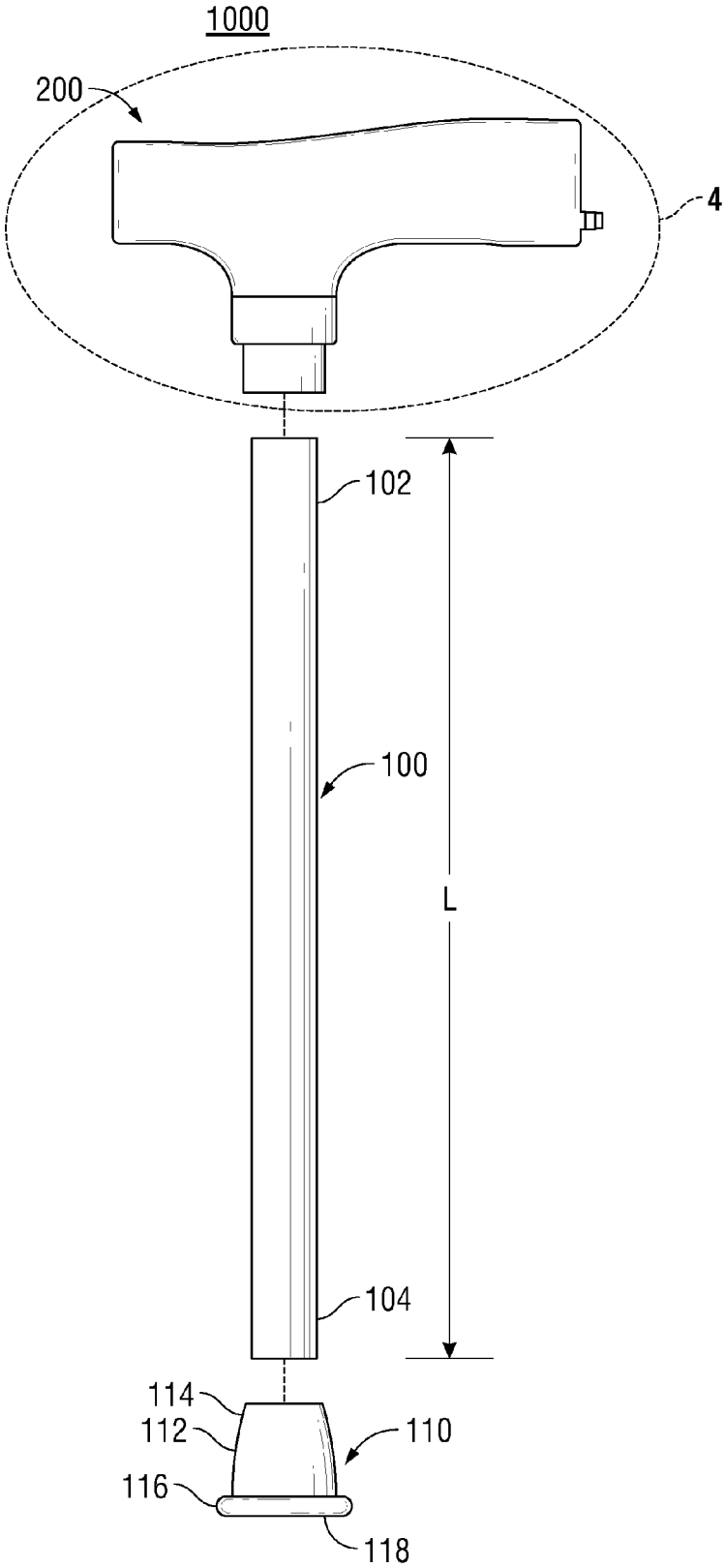
FIG. 1 is a side view of a cane, according to one embodiment of the present disclosure, including a shaft and a handle assembly shown with parts separated.

Various exemplary embodiments of the presently disclosed subject matter will now be described in detail with reference to the drawings wherein like reference characters identify similar or identical elements. Throughout the following discussion, the term "upper" should be understood as referring to that portion of the cane, or component thereof, that is closest to the user during proper use, whereas the term "lower" should be understood as referring to that portion of the cane, or component thereof, that is furthest from the user during proper use.

FIG. 1 illustrates one embodiment of a cane, which is identified by the reference character 1000, according to the principles of the present disclosure. The cane 1000 includes a shaft 100 having respective upper and lower portions 102, 104, and a handle assembly 200 that is attached to the upper portion 102 of the shaft 100.

Figure 2:
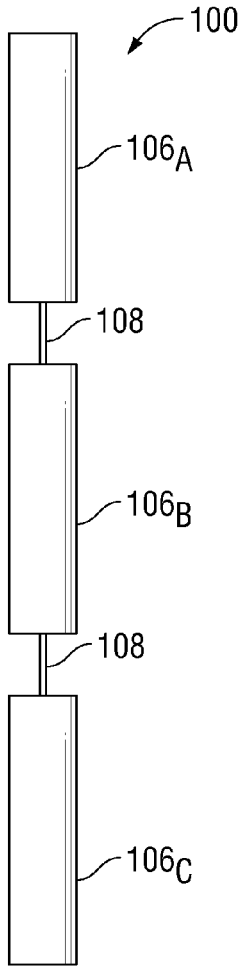
FIG. 2 is a side view of a collapsible shaft for use with the handle assembly seen in FIG. 1.
Figure 3:
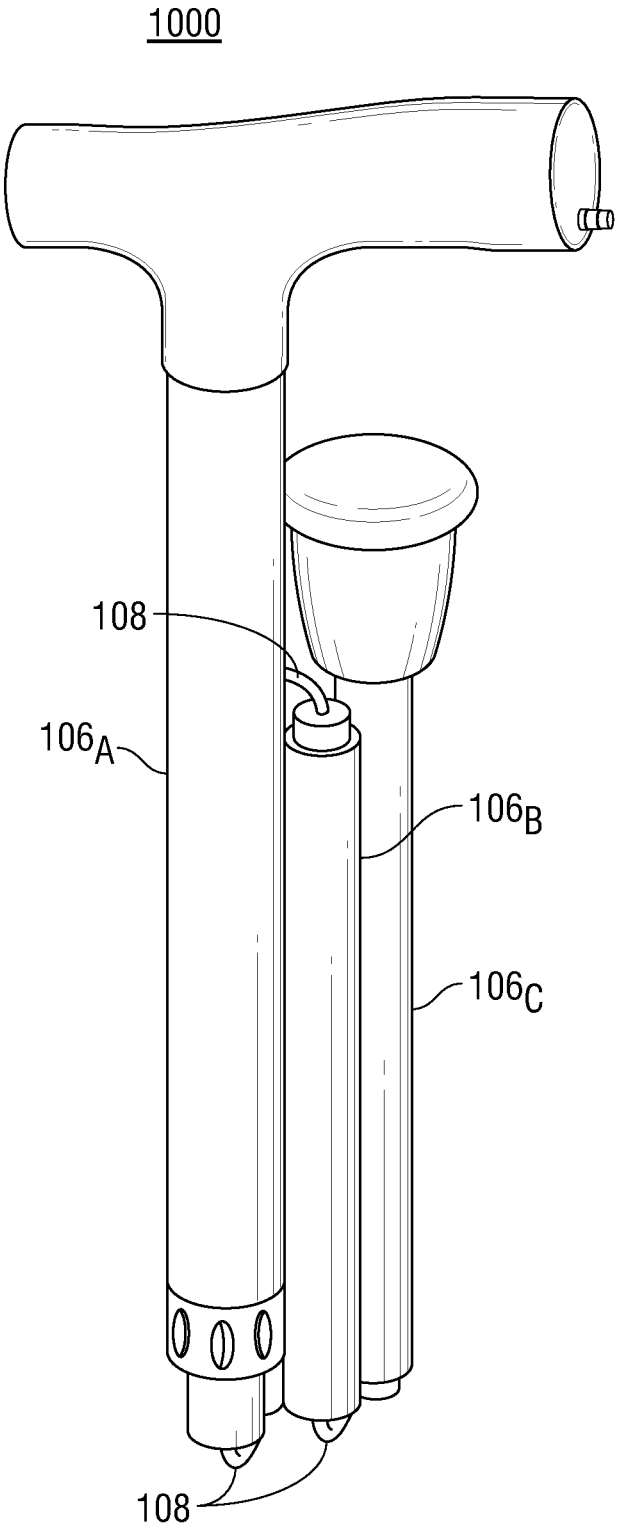
FIG. 3 is a side, perspective view of a cane including the collapsible shaft shown in FIG. 2 illustrated in a collapsed position.

In the embodiment illustrated in FIG. 1, the shaft 100 of the cane 1000 is shown as a solid structure defining a fixed length "L." However, in alternative embodiments of the present disclosure, it is envisioned that the length "L" of the shaft 100 may be varied by the user. Also, with momentary reference to FIGS. 2 and 3, the shaft 100 may include a segmented structure employing a plurality of individual sections $\mathbf{106}_A$, $\mathbf{106}_B$, $\mathbf{106}_C$ that are connected by one or more flexible cords 108, or other such members, whereby the cane 1000 can be collapsed by the user during non-use, e.g., to facilitate storage, as shown in FIG. 3.

Alternatively, the present disclosure contemplates that the shaft 100 may include a plurality of telescoping portions (not shown) that are adjustable relative to one another. In such embodiments, it is further envisioned that the shaft 100 may include securing structure (not shown) to maintain a desired length "L" (FIG. 1) of the shaft 100. For instance, the shaft 100 may include a plurality of holes that are selectively engagable with one or more depressible detents to maintain the desired length "L" of the shaft 100.

Referring again to FIG. 1, the illustrated embodiment of the cane 1000 includes a tip member 110 that is positioned at the lower portion 104 of the shaft 100. The tip member 110 is formed from a slip-resistant material, e.g., a resilient polymeric material, to increase the reliability of the cane 1000 during use. As illustrated, the tip member 110 includes a tapered body portion 112 with an upper end 114, and a rounded lower end 116 including a bottom surface 118. The body portion 112 further includes an opening (not shown) at the upper end 114 thereof that is configured and dimensioned to receive the shaft 100.

In various embodiments of the presently disclosed cane 1000, it is envisioned that the bottom surface 118 of the body portion 112 may be textured to further increase traction. For example, the bottom surface 118 may include a plurality of treads, protrusions, or the like. Additionally, it is envisioned that the tip member 110 may be either releasably secured to the shaft 100, e.g., to facilitate replacement thereof, or alternatively, that the tip member 110 may be integrally formed with the shaft 100.

Figure 4:
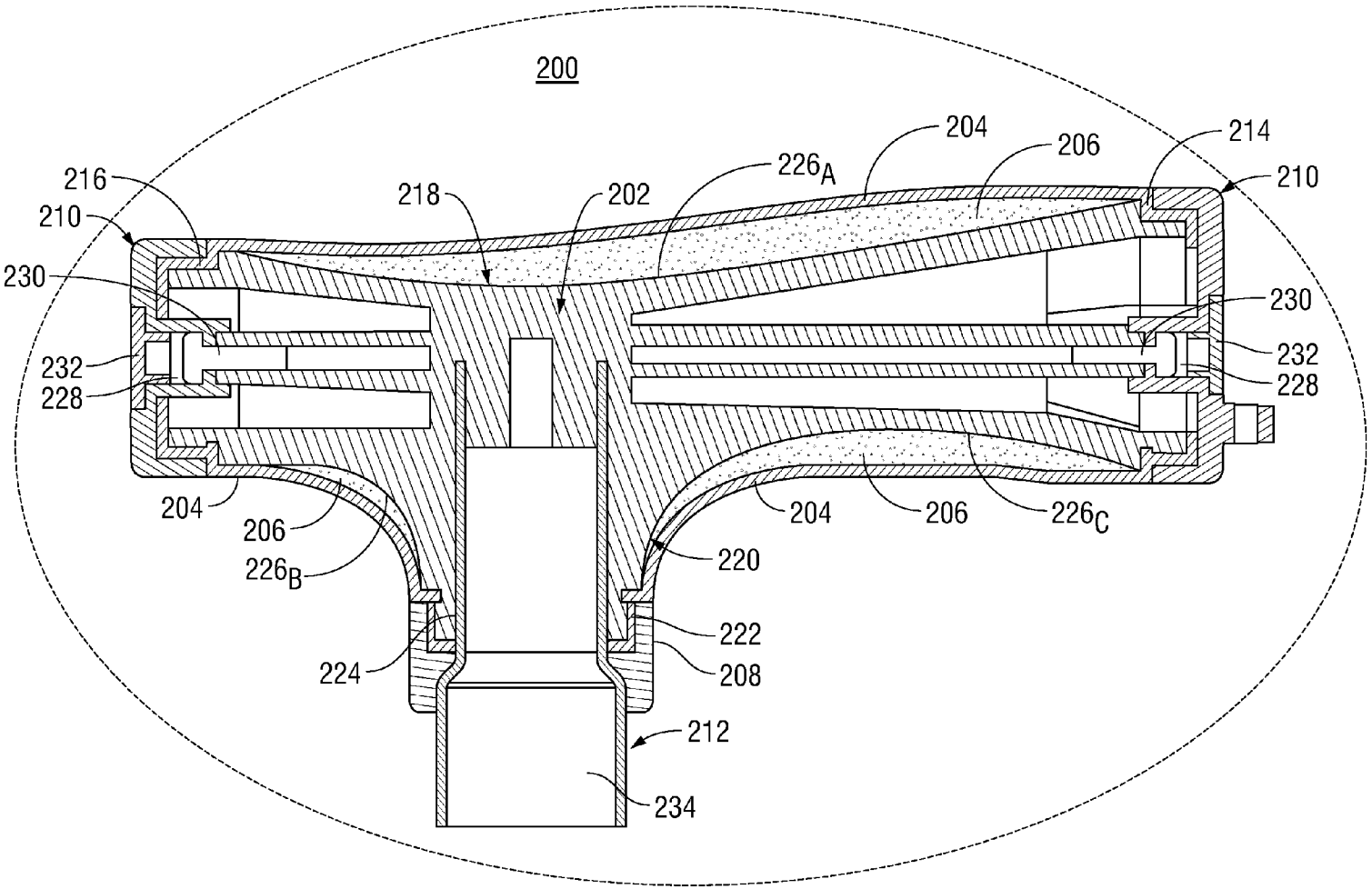
FIG. 4 is an enlarged, schematic view of the area of detail indicated in FIG. 1.

With reference now to FIGS. 1 and 4, the handle assembly 200 will be discussed. The handle assembly 200 includes an inner frame 202, an outer cover 204, a filler 206, a middle sleeve 208, one or more end members 210, and a connecting portion 212.

The inner frame 202 provides structure to the handle assembly 200, and may be formed from any suitable material, e.g., polymeric materials, stainless steel, wood, etc. The inner frame 202 provides a comfortable surface that is configured and dimensioned to fit within the user's hand to facilitate gripping, and includes opposing end portions 214, 216, an upper portion 218, and a lower portion 220 that includes an extension 222 defining an inner bore 224.

In one embodiment of the present disclosure, it is envisioned that inner frame 202 may include a configuration defining one or more wells, such as the wells $\mathbf{226}_A$, $\mathbf{226}_B$, and $\mathbf{226}_C$ illustrated in the particular embodiment shown in FIG. 4, for example. The well $\mathbf{226}_A$ is included on the upper portion 218 of the inner frame, whereas the wells $\mathbf{226}_B$, $\mathbf{226}_C$ are included on the lower portion 220 of the inner frame 202. As discussed in further detail below, the particular arrangement of the wells $\mathbf{226}_A$, $\mathbf{226}_B$, $\mathbf{226}_C$ illustrated in FIG. 4 enhances the user's comfort by providing a cushioned surface for the user's palm and fingers. While the embodiment of the handle assembly 200 shown in FIG. 4 is illustrated as including three (3) wells, i.e., the wells $\mathbf{226}_A$, $\mathbf{226}_B$, and $\mathbf{226}_C$, embodiments including greater or fewer numbers of wells are also within the scope of the present disclosure.

With continued reference to FIGS. 1 and 4, the outer cover 204 will be described. The outer cover 204 is secured to the inner frame 202 in a manner that will be detailed below, and may be formed from any suitable material, such as, for example, a resilient material, e.g., silicone, or a polymeric material. The resiliency of the material comprising the outer cover 204 allows the outer cover 204 to deform during use of the cane 1000, and cushions the impact upon the transfer of a load to the user's hand.

In one particular embodiment, the outer cover 204 is comprised, either partially or entirely, of a fluorescent material, such as, for example, phosphors or fluorescent minerals, fluorescein and fluorescein derivatives, rhodamines, tetramethylrhodamines, coumarins, resorufins, pyrenes, anthracenes, phenylenes, phthalocyanines, cyanines, xanthenes, amidopyrylium dyes, oxazines, quadrain dyes, carbopyronines, NBD derivatives, lanthanide chelates, metalloporphyrins, NIR fluorophores, rhodol dyes, naphthalimides and porphyrins. In this embodiment, exposure of the outer cover 204 to ambient light will "charge" the material comprising the outer cover 204 such that the outer cover 204 will emit a visible light. Accordingly, following exposure of the outer cover 204 to ambient light, the visibility of the outer cover 204 will be increased, particularly in dimly lit, or dark areas, thereby allowing the user to more easily locate the cane 1000.

The filler 206 is located between the inner frame 202 and the outer cover 204, e.g., in the wells $\mathbf{226}_A$, $\mathbf{226}_B$, $\mathbf{226}_C$, and further increases the resiliency of the handle assembly 200. In one particular embodiment of the present disclosure, the filler 206 includes a silicone gel. However, any material, or substance, suitable for the intended purpose of increasing the resiliency of the handle assembly 200 may be employed. Upon being subjected to an external force, such as, for example, the force applied by the user's hand during use of the cane 1000 as a walking aid, the filler 206 is displaced to thereby further cushion the impact upon the user's hand.

In one embodiment of the present disclosure, it is envisioned that the filler 206 may be comprised, either partially or entirely, of a fluorescent material. In this embodiment, it is envisioned that the outer cover 206 may be formed from a material permitting the passage of light into, and out of, the filler 206, e.g., a translucent or transparent material, to thereby allow the filler 206 to both "charge," and emit a visible light.

Referring still to FIGS. 1 and 4, the middle sleeve 208 is configured and dimensioned for engagement with the inner frame 202 adjacent the lower portion 220. The middle sleeve 208 is positioned about a portion of the outer cover 204, and applies a compressive force thereto to inhibit escape of the filler 206.

The end members 210 are configured and dimensioned for engagement with the inner frame 202 adjacent the end portions 214, 216. Specifically, the end members 210 are positioned about the end portions 214, 216, and a portion of the outer cover 204. When secured to the end portions 214, 216, similar to the middle sleeve 208, the end members 210 apply a compressive force to the outer cover 204 to inhibit escape of the filler 206.

In the embodiment of the handle assembly 200 seen in FIGS. 1 and 4, each of the end members 210 includes a recess 228 that is configured and dimensioned to receive a screw 230, or other such securement member, e.g., a pin, a rivet, or the like. Following positioning of the end members 210 about the end portions 214, 216, the screws 230 secure the end members 210 to the inner frame 202, and thereafter, a pair of caps 232 can be fitted to the end members 210 to obscure the screws 230.

Although the embodiment of the presently disclosed handle assembly 200 is illustrated as including the aforedescribed screws 230 and caps 232 in FIGS. 1 and 4, in additional embodiments, the end members 210 may be configured, dimensioned, and adapted for connection to the inner frame 202 in alternative manners without departing from the scope of the present disclosure. For example, it is envisioned that the end members 210 may be configured and dimensioned for engagement with the end portions 214, 216 of the inner frame 202 in snap-fit relation. In such an embodiment, the need for the screws 230 and the caps 232 would be obviated.

As best seen in FIG. 4, the connecting portion 212 is configured and dimensioned for positioning within the bore 224 defined in the lower portion 220 of the inner frame 202. The connecting portion 212 includes an interior hollow 234 that is configured and dimensioned to receive the upper portion 102 (FIGS. 1, 2) of the shaft 100 to facilitate assembly of the cane 1000.

In one embodiment of the present disclosure, it is envisioned that the connecting portion 212 may be configured and dimensioned to releasably receive the upper portion 102 of the shaft 100, e.g., via an interference fit, or through the use of screws, pins, or the like. Alternatively, it is envisioned that the connecting portion 212 and the upper portion 102 of the shaft 100 may be fixedly connected, such as, for example, through the use of adhesives, or an integral connection, e.g., monolithic formation.

Although illustrated as including a substantially tubular configuration in the embodiment illustrated in FIGS. 1 and 4, in alternative embodiments, the connecting portion 212 may include other geometrical configurations without departing from the scope of the present disclosure.

The above description, disclosure, and figures should not be construed as limiting, but merely as exemplary of particular embodiments. It is to be understood, therefore, that the disclosure is not limited to the precise embodiments described, and that various other changes and modifications may be effected by one skilled in the art without departing from the scope or spirit of the present disclosure. Additionally, persons skilled in the art will appreciate that the features illustrated or described in connection with one embodiment may be combined with those of another embodiment, and that such modifications and variations are also intended to be included within the scope of the present disclosure. Therefore, the above description should not be construed as limiting, but merely as exemplary of particular embodiments.

What is claimed is:

1. A handle assembly for use with a cane defining a longitudinal axis, the handle assembly comprising:

an inner frame with an upper portion, a lower portion, and opposing end portions, the lower portion configured for transversely securing to the cane, the inner frame defining a plurality of discrete, internal wells including a first internal well and a second internal well spaced apart vertically along the longitudinal axis of the cane;

an outer cover positioned about the inner frame, a pair of end members configured and dimensioned to engage with the opposite end portions of the inner frame and to secure at least a portion of the outer cover to the inner frame; and a filler positioned within the internal wells and beneath the outer cover, the filler being formed of a resilient, fluorescent material to increase resiliency of the handle assembly to maximize comfort during use, and facilitate visualization and location of the cane.

2. The handle assembly of claim 1, wherein the outer cover is at least partially formed from a material permitting light to pass therethrough, whereby light passes through the outer cover to charge the filler to facilitate emission of light from the handle assembly.

3. The handle assembly of claim 1, wherein the outer cover is at least partially formed from a resilient material.

4. The handle assembly of claim 1, wherein the filler comprises a gel.

5. The handle assembly of claim 1, wherein the first internal well is positioned within the upper portion of the inner frame, and the second internal well is positioned within the lower portion of the inner frame, the first and second internal wells being separate structures.

6. The handle assembly of claim 5, wherein the plurality of discrete, internal wells further includes a third internal well positioned within the lower portion of the inner frame, the third internal well being spaced from the first internal well along the longitudinal axis of the cane.

7. The handle assembly of claim 1, wherein the outer cover is secured to the inner frame at the end portions and the lower portion.

8. The handle assembly of claim 7, wherein the handle assembly further includes a sleeve configured and dimensioned for engagement with the lower portion of the inner frame, the sleeve being configured and dimensioned for positioning about at least a portion of the outer cover to secure the outer cover to the inner frame, and thereby inhibit escape of the filler.

9. The handle assembly of claim 1, wherein the inner frame is configured and dimensioned such that a user's palm is cushioned by the filler positioned within the first internal well, and one or more of a user's fingers are cushioned by the filler positioned within the second internal well, the inner frame being further configured such that the user's palm extends transversely in relation to the longitudinal axis of the cane during use of the handle assembly.

10. A cane comprising:

a handle assembly defining a plurality of discrete, internal wells including a first internal well and a second internal well, an outer cover positioned about the plurality of discrete, internal wells, a pair end members engaging the internal wells and securing at least a portion of the outer cover to the wells, each of the internal wells retaining a filler including a resilient, fluorescent material to increase resiliency of the handle assembly to maximize comfort during use, and facilitate visualization and location of the cane; and a shaft extending transversely from the handle assembly along a longitudinal axis, the first internal well and the second internal well being spaced apart along the longitudinal axis of the shaft.

11. The cane of claim 10, wherein the handle assembly includes:

an inner frame with an upper portion, a lower portion, and opposing end portions to define the plurality of discrete, internal wells; and the outer cover positioned about the inner frame, the filler being positioned between the inner frame and the outer cover.

12. The cane of claim 11, wherein the outer cover is at least partially formed from a material permitting light to pass therethrough, whereby light passes through the outer cover to charge the filler to facilitate emission of light from the cane.

13. The cane of claim 11, wherein the outer cover is at least partially formed from a resilient material.

14. The cane of claim 10, wherein the handle assembly is configured and dimensioned such that a user's palm is cushioned by the filler positioned within the first internal well, and one or more of a user's fingers are cushioned by the filler positioned within the second internal well, the handle assembly being further configured such that the user's palm extends transversely in relation to the longitudinal axis of the shaft during use of the cane.

15. A cane comprising a handle assembly having an inner frame with an upper portion, a lower portion, and two opposite ends, and a shaft extending transversely from the lower portion of the handle assembly along a longitudinal axis for use by a user in increasing stability, wherein the improvement comprises a plurality of discrete, internal wells including a first internal well and a second internal well formed in the handle assembly, each of the internal wells retaining a filler including a resilient, fluorescent material to increase resiliency of the handle assembly to maximize comfort during use, and facilitate visualization and location of the cane, the first internal well and the second internal well being spaced apart along the longitudinal axis of the shaft, and a pair of end members engaging the first and second internal wells for inhibit escape of the filler therein.

16. The improved cane of claim 15, wherein the handle assembly is configured and dimensioned such that a user's palm is cushioned by the filler positioned within the first internal well, and one or more of a user's fingers are cushioned by the filler positioned within the second internal well, the handle assembly being further configured such that the user's palm extends transversely in relation to the longitudinal axis of the shaft during use of the cane.

* * * * *